US012082728B2

(12) United States Patent
Lampsa et al.

(10) Patent No.: US 12,082,728 B2
(45) Date of Patent: Sep. 10, 2024

(54) APPARATUS FOR HOLDING LIQUID CONTAINERS

(71) Applicants: Evan J. Lampsa, Wales, WI (US); John B. Lampsa, Wales, WI (US)

(72) Inventors: Evan J. Lampsa, Wales, WI (US); John B. Lampsa, Wales, WI (US)

( * ) Notice: Subject to any disclaimer, the term of this patent is extended or adjusted under 35 U.S.C. 154(b) by 0 days.

(21) Appl. No.: 17/896,437

(22) Filed: Aug. 26, 2022

(65) Prior Publication Data

US 2023/0067266 A1 Mar. 2, 2023

Related U.S. Application Data

(60) Provisional application No. 63/237,237, filed on Aug. 26, 2021.

(51) Int. Cl.

| | |
|---|---|
| ***A47G 23/02*** | (2006.01) |
| ***A47G 23/06*** | (2006.01) |
| ***B65D 1/34*** | (2006.01) |
| ***B65D 1/36*** | (2006.01) |
| ***B65D 1/46*** | (2006.01) |

(52) U.S. Cl.

CPC ..... *A47G 23/06* (2013.01); *B65D 1/36* (2013.01); *B65D 1/46* (2013.01)

(58) Field of Classification Search

CPC ..... A47G 23/06; A47G 23/0641; A47G 23/0208; B65D 1/36; B65D 1/46; B65D 5/503; B65D 81/133; Y10S 229/904

USPC ..... 206/427, 564, 518, 562; 220/23.8, 556, 220/738, 23.83, 555; 229/406, 407, 904; 294/143, 159; D7/553.4, 557; D9/755, D9/761, 737

See application file for complete search history.

(56) References Cited

U.S. PATENT DOCUMENTS

| | | | | | |
|---|---|---|---|---|---|
| 1,528,620 | A | | 3/1925 | Kuwahara et al. | |
| 1,593,602 | A | | 7/1926 | Scharphuis | |
| 2,096,825 | A | | 10/1937 | Roman | |
| 2,107,381 | A | | 2/1938 | Leppke | |
| 2,352,684 | A | | 7/1944 | Braddock | |
| D170,164 | S | * | 8/1953 | Randall | D7/553.3 |
| 2,865,547 | A | * | 12/1958 | Van Dyke | B65D 1/36 229/406 |
| D236,575 | S | * | 9/1975 | Vigue | D9/761 |
| 3,964,629 | A | | 6/1976 | McCabe | |
| D250,243 | S | * | 11/1978 | Vigue | D9/761 |
| 4,218,008 | A | * | 8/1980 | Veilleux | A47G 23/06 229/406 |
| D279,259 | S | * | 6/1985 | Bixler | D9/755 |
| D289,010 | S | * | 3/1987 | Vigue | D9/755 |
| 4,718,555 | A | * | 1/1988 | Amberg | B65D 1/36 D7/553.3 |
| D309,258 | S | * | 7/1990 | Vigue | D9/425 |

(Continued)

*Primary Examiner* — Gideon R Weinerth

(74) *Attorney, Agent, or Firm* — RYAN KROMHOLZ & MANION, S.C.

(57) ABSTRACT

A cup and/or food holding tray for stable storage and movement of food/beverage containers, having a center cup basin and periphery cup basins about the center cup basin, wherein each cup basin is capable of receiving and securely holding a food/beverage container. The invention further comprises ribbing between adjacent cup basins. The center cup basin and the ribbing provide for increased structural rigidity of the cup holding tray of the invention. The cup basins are defined by multiple planar support walls.

8 Claims, 7 Drawing Sheets

(56) References Cited

U.S. PATENT DOCUMENTS

D319,579 S * 9/1991 Vigue ..... D9/755
5,096,065 A * 3/1992 Vigue ..... B65D 1/36 229/407
5,316,173 A * 5/1994 Emery ..... B65D 71/70 220/507
5,713,619 A * 2/1998 DuBois ..... A47G 23/06 294/159
6,076,876 A * 6/2000 Letourneau ..... A47G 23/06 294/143
D436,853 S * 1/2001 Sussman ..... D9/755
6,398,056 B1 * 6/2002 Letourneau ..... B65D 71/70 220/23.8
6,964,443 B1 11/2005 Newton
D513,596 S 1/2006 Hamblin et al.
7,225,927 B2 * 6/2007 Sweeney ..... B65D 1/36 220/23.8
D587,529 S 3/2009 Pratt
D587,970 S 3/2009 Zack et al.
D592,014 S 5/2009 Bizzell et al.
7,762,396 B1 * 7/2010 Yang ..... B65D 1/36 206/427
D640,570 S * 6/2011 Landry ..... D9/755
D641,260 S * 7/2011 Breton ..... D9/755
D649,068 S * 11/2011 Breton ..... D9/755
D671,427 S * 11/2012 Landry ..... D9/755
D680,449 S * 4/2013 Breton ..... D9/755
D737,104 S 8/2015 Sobotka
D745,807 S 12/2015 Harris et al.
D809,936 S * 2/2018 Yong ..... D9/755
9,955,806 B2 5/2018 Jaeckel
D825,997 S 8/2018 Dolinsky
10,137,814 B2 * 11/2018 Liebowitz ..... B60N 3/103
D835,467 S 12/2018 Dolinsky et al.
10,238,224 B1 * 3/2019 Nazarian ..... A47G 23/0625
D872,540 S 1/2020 Mulder et al.
D894,018 S * 8/2020 Dominion ..... D7/553.3
10,888,187 B2 1/2021 Yang et al.
10,959,557 B1 * 3/2021 Nazarian ..... B65D 1/36
D924,695 S * 7/2021 Dominion ..... D7/553.4
D924,696 S * 7/2021 Dominion ..... D7/553.4
D926,525 S * 8/2021 Bohn ..... D7/553.2
D932,320 S * 10/2021 Dominion ..... D7/553.4
2005/0012009 A1 * 1/2005 Sweeney ..... B65D 1/36 248/311.2
2009/0211937 A1 * 8/2009 Sharma ..... E06B 9/581 206/515
2011/0120995 A1 * 5/2011 Landry ..... B65D 1/36 229/407
2011/0259785 A1 * 10/2011 Veenje ..... D21J 3/00 206/564
2011/0278187 A1 * 11/2011 Yang ..... B65D 71/70 206/427
2012/0012500 A1 * 1/2012 Breton ..... B65D 1/36 206/563
2015/0375919 A1 * 12/2015 Jaramillo de Echeverri ..... B65D 65/466 264/328.2
2017/0172330 A1 * 6/2017 Cameron ..... B65D 25/24
2019/0307277 A1 * 10/2019 Yang ..... B65D 25/06
2021/0070494 A1 * 3/2021 Garza ..... B65D 5/001
2023/0067266 A1 * 3/2023 Lampsa ..... A47G 23/06
2024/0115064 A1 * 4/2024 Lucas ..... A47G 23/0616

* cited by examiner

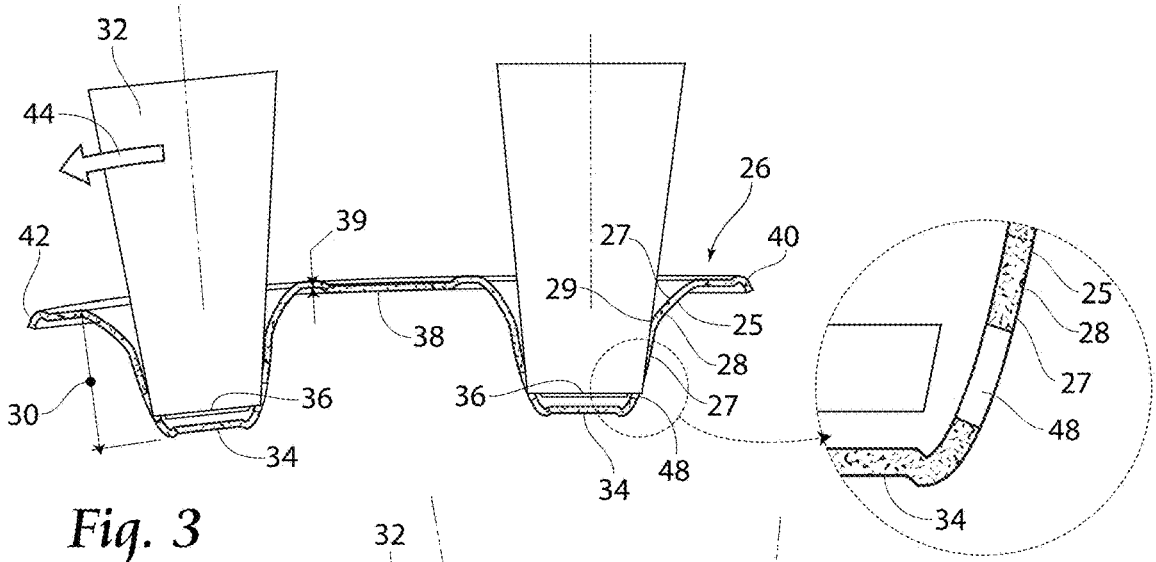
*Fig. 3*
PRIOR ART
*Fig. 3A*
PRIOR ART
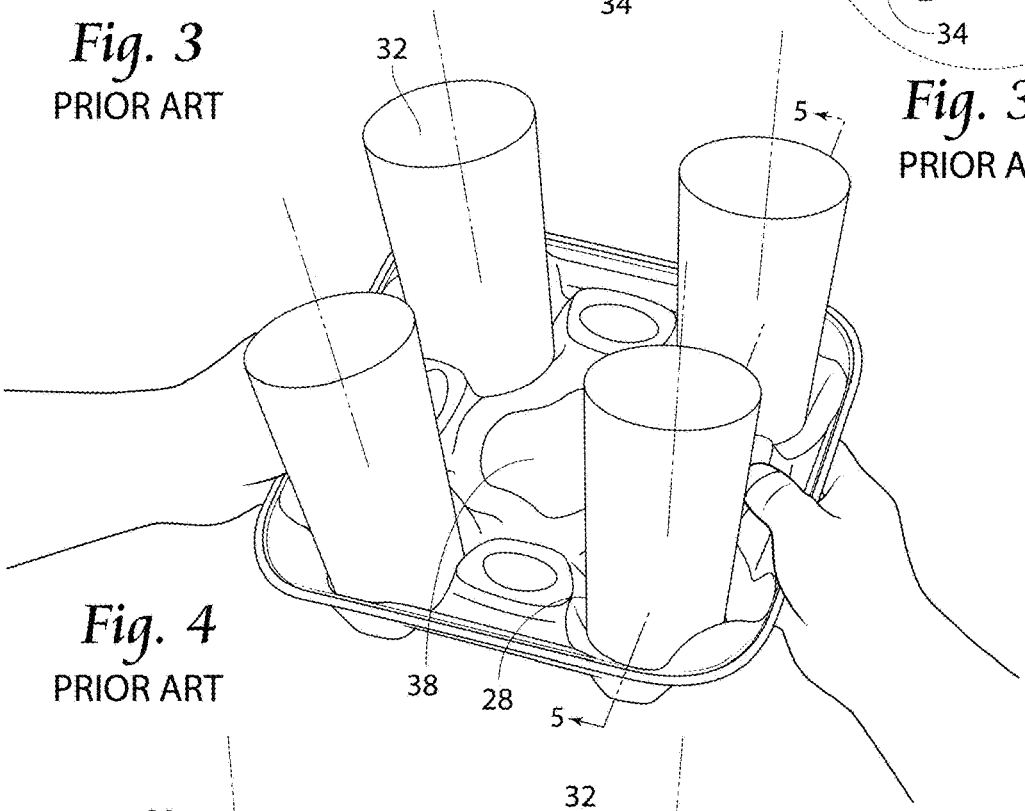
*Fig. 4*
PRIOR ART
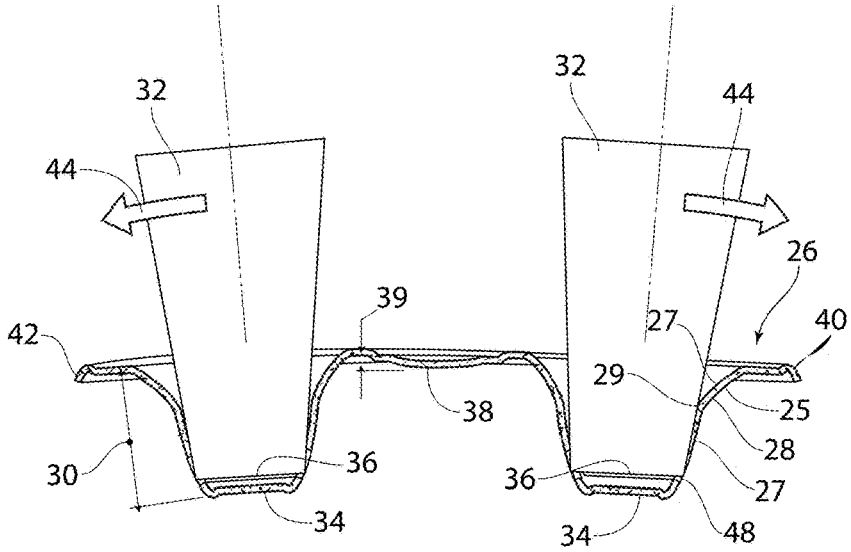
*Fig. 5*
PRIOR ART

APPARATUS FOR HOLDING LIQUID CONTAINERS

RELATED APPLICATIONS

This application claims the benefit of provisional patent application Ser. No. 63/237,237, filed 26 Aug. 2021.

BACKGROUND OF THE INVENTION

The present invention relates to storage technology and more specifically, to an improved apparatus for storage of drink containers. This improved apparatus has a center cup basin providing for insertion of a fluid container into the basin in a manner substantially identical to that of the periphery cup basins of the apparatus. This improved apparatus further provides for ribbing structures positioned between the center cup basin and each periphery cup basin. The center cup basin, along with the ribbing structures, provide for a rigid structure in the cup holding tray.

The use of devices for storing containers, commonly called drink trays, have been readily used since 1948 when the McDonald's Corporation transferred to disposable serving products. Such an apparatus for storing drinks can be made of paperboard, molded pulp, plastic or other materials, or a combination thereof. This drink tray technology has become widely used in the fast-food industry, among other industries. Though called drink trays, these trays can also be used to store and transfer solid foods as well. The drink tray allows for the seller, a food and/or beverage establishment, to place multiple items of drink and/or food onto a single storage template for transfer and storage by the customer.

As will be seen, the prior art drink trays typically have a square or rectangular receiving surface. Cup basins are positioned in close proximity to each corner of the receiving surface. Each cup basin has a basin depth which allows for a drink container, or food container, to rest at least substantially in the cup basin so that the container will not be easily dislodged when the drink tray is picked up, carried and/or positioned on a flat surface. A center depression may be positioned centrally on the receiving surface with respect to all of the cup basins. This center depression has a depth substantially less than the basin depth. As a result, a drink container, or food container, positioned in the center depression may be easily removed or moved out of balance even when the drink tray is positioned on a flat surface. Thus, the prior art drink tray is unable to store more containers than the number of cup basins around its periphery. Further, the center of the drink tray is unable to be used as a stable storage of drink and/or food.

Additionally, the prior art drink trays impart inherent instability during the transfer of a full or partially full drink tray to and by a customer. A full drink tray is defined as a drink tray having all the cup basins about the periphery of the drink tray storing a drink or food container. The center depression may or may not be occupied. A partially full drink tray is defined as a drink tray having less than the all the cup basins about the periphery of the drink tray storing a drink or food container. The center depression may or may not be occupied. A drink tray is typically used where multiple items of drink and/or food are purchased by a customer and placed in the drink tray, making the drink tray full or partially full. In such a case, a user, such as a food vendor or consumer of such a drink tray, full or partially full, typically holds such a tray on a single side of the receiving surface or opposing sides of the receiving surface. In doing so, the weight of the containers in the cup basins imparts a downward and angular force causing the receiving surface to bend and/or torque depending of the positioning of the drink containers on the receiving surface, typically near the respective cup basin on a side proximate to the center of the receiving surface. This bending, or torqueing, results in the displaced positioning of the drink or food container. This displacement will result in contents of the respective drink and food containers pouring out of the containers or the containers dislodging from the cup basins.

The prior art does contain ribbing. However, this prior art ribbing is at the base of cup basins. This prior art ribbing reinforces the base of the cup basin so that the base of the cub basin may support more weight. This prior art ribbing does not prevent the drink tray from bending or torqueing while in use, full or partially full with drink and/or food containers.

Finally, the prior art cup basins have support walls extending from the receiving surface to a position in proximity to the basin, but not in contact with the basin. The support walls act to contain the drink and/or food containers within each respective cup basin. Each such support wall of a respective basin may be defined by two distinct planner surfaces, connected to one another, to form an upper planner surface and a lower planer surface. However, the upper planar surface and the lower planar are positioned at different angles with respect to the base. The result of such a design is the need for a more complex mold design for a cup basin. A wall having a single planar surface or a single curved surface would provide for reduced complexity in the mold design for the cup basin.

As such, a need exists for an apparatus for storing containers, such as a drink tray, which provides for a centrally positioned cup basin while also increasing the rigidity of the apparatus for storing containers while in use. Further, a need exists for an apparatus for storing containers, such as a drink tray, which provides for a ribbing structure increasing the rigidity of the apparatus for storing container while in use. Finally, a need exists for an apparatus for storing containers, such as a drink tray, having cup basins with walls comprising a single planar surface or a single curved surface extending from the receiving surface to the basin.

SUMMARY OF THE INVENTION

The present invention relates to storage technology and more specifically, to an improved apparatus for storage of drink and/or food containers. This improved apparatus has a center cup basin providing for insertion of a container into the basin in a manner substantially identical to that of the periphery cup basins of the apparatus. This improved apparatus further provides for ribbing structures positioned between the center cup basin and each periphery cup basin. The center cup basin, along with the ribbing structures, provide for a rigid structure in the cup and/or food holding tray.

The structure of the cup and/or food holding tray of the invention addresses the challenges of the prior art trays by application of a molded center cup basin into the formation of the tray. Unlike the prior art which provides for one or more shallow recesses at the center of the prior art trays that are incapable of securely holding a food/beverage container, the center cup basin in the present invention is designed to receive and securely hold a food/beverage container.

The cup and/or food holding tray of the invention comprises four basins about the periphery of the holding tray each for receiving a food/beverage container, and the center cup basin as described. Each basin is in molded contact with a plate to form the cup holding tray of the invention, with each basin having an opening formed in the tray for receiving the food/beverage container into a basin cavity. The basin cavity is further defined by at least three, preferably four, support walls. The support walls extend away from the plate and end at a basin base to define a base of each cup basin.

An embodiment of the cup and/or food holding tray of the invention comprises an apparatus for holding a plurality of containers being a one-piece unitary molded plate having an outer periphery and a central region, a plurality of container basins formed in the plate, each container basin sized to receive and retain one of the plurality of containers, one container basin located in the central region, the remaining container basins formed within the outer periphery of the molded plate and reinforcement ribs formed in the molded plate between each of the container basins. The molded plate may be rectangular and/or have four corners. Each container basin is formed from three or four support walls substantially orthogonal to the molded plate. A container basin base is formed at a preselected depth from the molded plate and at a distal end of each of the support walls relative to the molded plate. The container basin located in the central region may be formed equidistant from the remaining container basins. Preferably the number of container basins is five. Each reinforcement rib is preferably V-shaped and along with the open gap of the "V" shape forms a substantially equilateral triangle within the molded plate.

Another embodiment of the cup and/or food holding tray of the invention comprises a one-piece unitary molded plate having an outer periphery and a central region, five container basins formed in the plate, each container basin sized to receive and retain one of the plurality of beverage containers, one of the five container basins located in the central region, the remaining container basins formed about said central region and within the outer periphery of the molded plate and reinforcement ribs formed in the molded plate between each of the container basins. The molded plate may be rectangular and/or have four corners. Each container basin is formed from three or four support walls substantially orthogonal to the molded plate. A container basin base is formed at a preselected depth from the molded plate and at a distal end of each of the support walls relative to the molded plate. The container basin located in the central region may be formed equidistant from the remaining container basins. Preferably the number of container basins is five. Each reinforcement rib is V-shaped and forms a substantially equilateral triangle within the molded plate. More specifically, each reinforcement rib is V-shaped whereby the two surfaces of the V-shaped rib in combination with the open gap between the two surfaces of the V-shaped rib forms a substantially equilateral triangle within the molded plate.

In the prior art the food/beverage containers are only securely positioned and attached to the tray about the periphery of the tray. As a result, the food/beverage containers impart a bending moment upon the prior art tray for which the tray lacks a design to compensate. The moment causes the tray to bend or torque, typically away from the tray center. As a result, the contents of the food/beverage containers uncontrollably dispense out of or the food/beverage containers dislodge from the prior art tray altogether. Unlike the prior art trays, the added center cup basin counters the described bending moment. Instead, the center cup basin imparts a center focused center of mass upon the tray. The location of the center cup basin provides for the center cup basin acting as a torque and/or bending reducer by countering the mass positioned in the respective peripheral basins. Thus, the center cup basin provides for a rigid cup holding tray of the invention.

Additionally, the invention provides for ribbing between adjacent cup basins. An equilateral triangular construction, with the side at least substantially planar to the plate of the cup holding tray, of the ribbing further acts to reduce bending or torqueing of the cup holding tray while in use. Another aspect the ribbing may provide is for a narrow U-shape body. In a further aspect of the ribbing, the ribbing may provide for molded, solid extensions between adjacent cup basins.

Additionally, the cup holding tray of the invention provides for support walls having a single plane. In another aspect of the support walls, these planar walls may be curved.

The invention provides for multiple orientations of food/beverage containers to be housed on or in the cup holding tray.

These and other features will be described in further detail below.

BRIEF DESCRIPTION OF THE DRAWINGS

FIG. 3 is a cross-sectional view of the prior art cup holding tray, along line 3 of FIG. 2, illustrating bending, or torqueing, of the prior art cup holding tray.

FIG. 3A is an exploded cross-sectional view of a portion of the prior art cup holding tray.

FIG. 4 is a perspective view of the prior art cup holding tray held by a user on a first side of the prior art cup holding tray and on a second side opposite the first side.

FIG. 5 is a cross sectional view of the prior cup holding tray, along line 5 of FIG. 4, illustrating bending, or torqueing, of the prior art cup holding tray.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described below, the details may be changed without departing from the invention which is defined by the claims.

Figure 1:
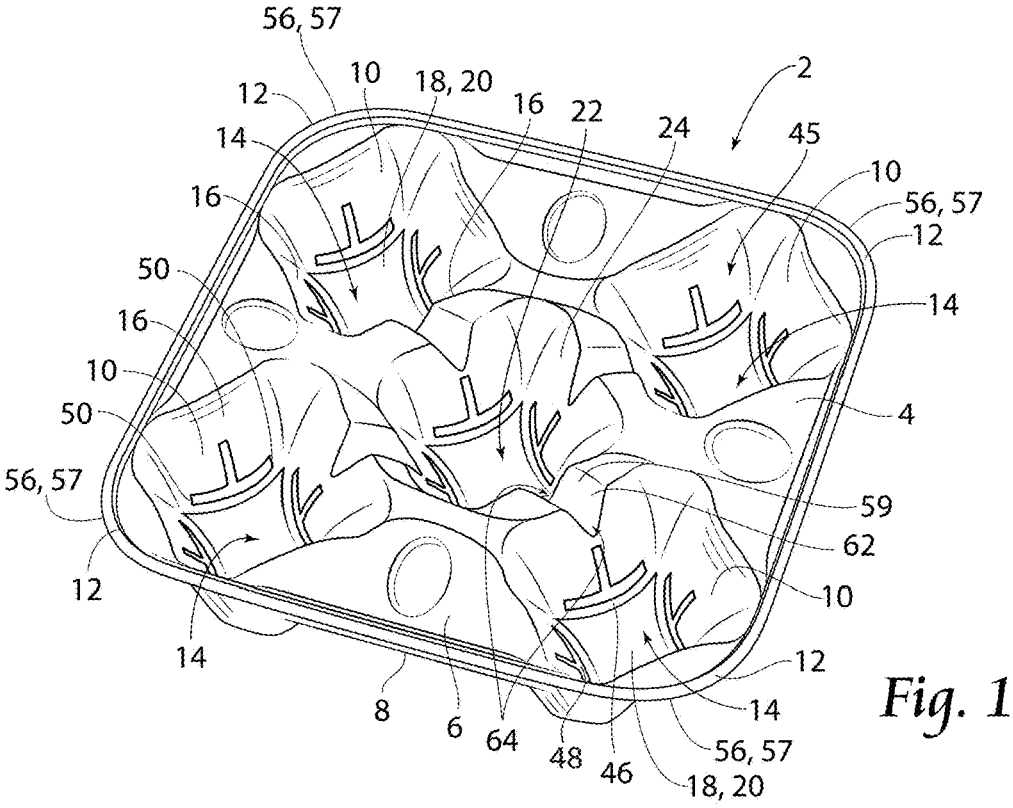
FIG. 1 is a perspective view of a cup holding tray of the invention.

With attention to FIG. 1, an apparatus for holding liquid containers or food containers 2, i.e. a cup holding tray or drink tray or food tray, of the invention is illustrated. The cup holding tray 2 is a unitary, molded design. The cup holding tray 2 is preferably molded to a finished product using substantially moisture resistant materials, such as fibrous pulp. Alternatively, the tray 2 may be made of paperboard, plastic or other materials, or a combination thereof.

Figure 8A:
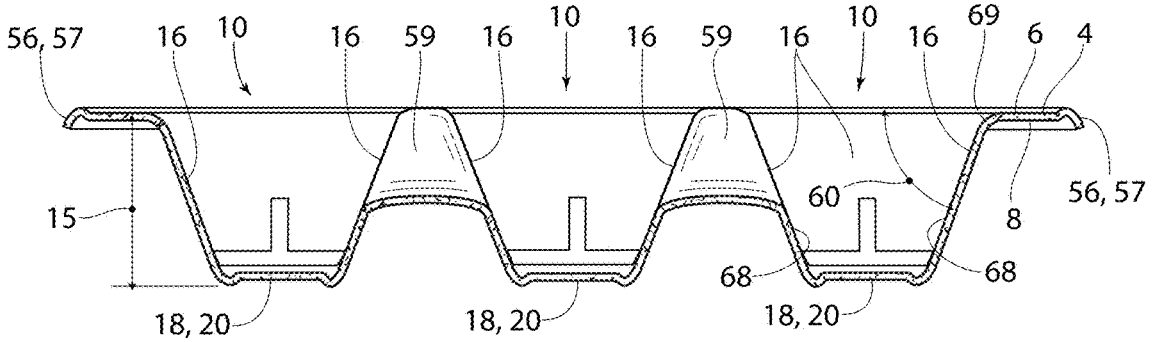
FIG. 8A is a cross-sectional view of the cup holding tray, along line 8A of FIG. 6, illustrating support walls of cup basins and ribbing between adjacent cup basins.

A preferred embodiment of the cup and/or food holding tray 2 is illustrated in FIG. 1. The cup holding tray 2 comprises a plate 4 with a plate top surface 6 and a plate bottom surface 8, opposite the top surface 6. The top surface 6 and the bottom surface 8 have a preferably square or rectangular shape. A cup basin 10 is positioned in close proximity to at least one of the corners 12 of the plate 4. Preferably a cup basin 10 is positioned in close proximity to each corner 12 of the plate 4, collectively referred to as the periphery cup basins. Each cup basin 10 is moldably connected to the plate 4 and extends from the top surface 6, towards and beyond the bottom surface 8, to provide for a cup basin cavity 14. Each cup basin preferably comprises four support walls 16. The support walls 16 are moldably connected to the plate 4, providing for the molded connection between the plate 4 and the cup basin 10. Opposite the plate 4, each wall 16 of a basin 10 is moldably connected to a basin base 18 to provide for a base 20 of the basin 10 and to further define the cavity 14. Each basin 10 has a basin depth 15, illustrated in FIG. 8A, allowing for a food/beverage container 32, illustrated in FIG. 11, to be securely positioned in the respective basin 10. As illustrated in FIG. 8A, the basin depth 15 is defined by the distance from the plate bottom surface 6 to the basin base 18.

At least in close proximity to the center 22 of the plate 4, a center cup basin 24 is positioned and formed. The center cup basin 24 has the same properties as the cup basin 10, with the exception of its position with respect to the plate 4. The center cup basin 24 is positioned substantially equidistant from each of the periphery cup basins 10.

The benefits of the cup holding tray 2 are better appreciated with a review of the prior art technology. With attention to FIGS. 2 to 5, the prior art consists of an exemplary prior art cup holding tray 26. The cup holding tray 26 comprises four periphery cup basins 28. The periphery cup basins 28 have a prior art basin depth 30 allowing for a food/beverage container 32 to be positioned in said prior art basin 28, with a container base 36 at or substantially close to the prior art base 34. The prior art depth 30 measures approximately between 1.70 and 2.3 inches. The cup holding tray 26 further comprises a center recess 38. The center recess 38 has a center recess depth 39 which is substantially less than the prior art basin depth 30 and the basin depth 15. The depth 39 of the center recess 38 prevents the secured positioning of a container 32 in the recess 38. As a result, any movement of the prior art cup holding tray 26 would result in the container 32 oscillating and becoming separated from the recess 38. Thus, the prior art cup holding tray 26 does not possess a center cup basin 24 as taught in the cup holding tray 2 of the present invention.

Figure 2:
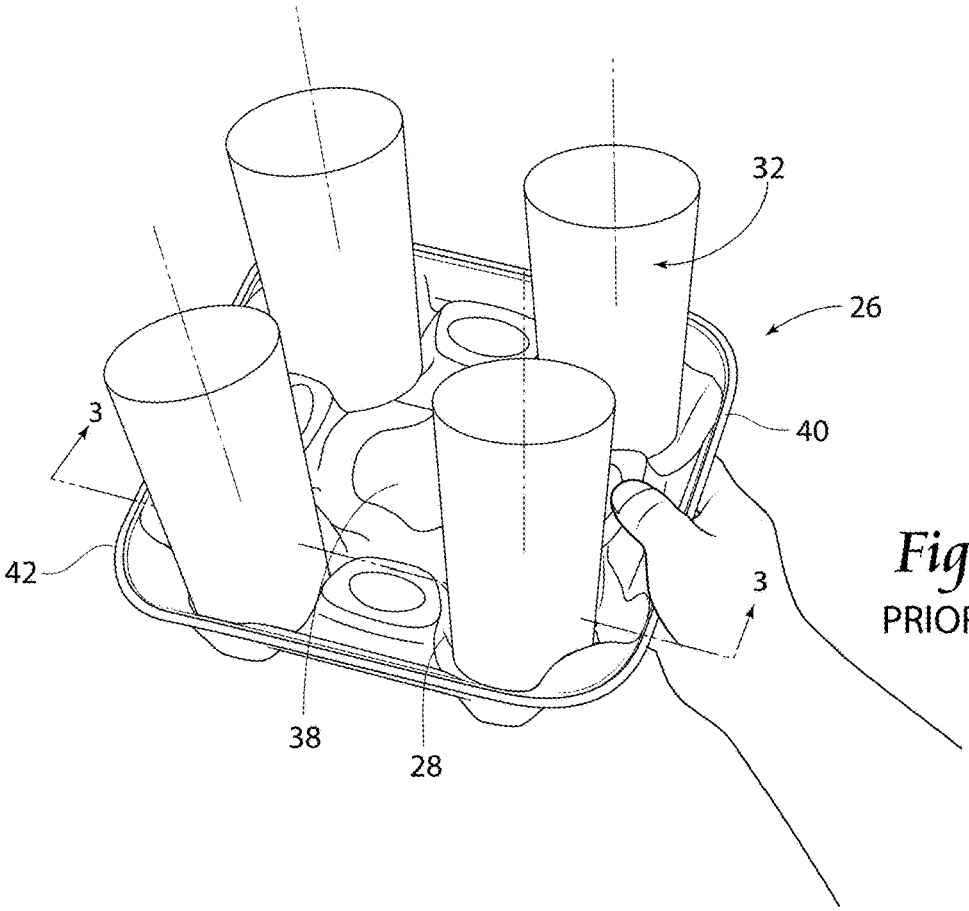
Fig. 2 PRIOR ART
FIG. 2 is a perspective view of a prior art cup holding tray held by a user on a first side of the prior art cup holding tray.

As illustrated in FIGS. 2 and 3, where a user holds the prior art cup holding tray 26 on the cup holding tray first side 40, the lack of a center basin illustrates intrinsic structural weaknesses in the prior art tray 26. As seen in FIGS. 2 and 3, containers 32 are placed in each basin 28 of the prior art tray 26. The user application of holding the cup holding tray 26 on the first side 40 results in a bending, or torqueing, of the tray 26. This bending, or torqueing, 44 results from the weight of the containers in close proximity to the cup holding tray second side 42 imparting a bending moment upon the tray 26 for which the tray 26 lacks structural integrity to compensate. As a result of the bending, or torqueing, 44 of the prior art tray 26, the contents in the containers 32 are displaced and/or the containers 32 are dislodged all together from the prior art tray 26. As illustrated in FIGS. 4 to 5, where the prior art tray 26 is held by a user on the first side 40 and the second side 42, the same or similar resulting moment occurs towards the respective sides (40, 42) for which the tray 26 lacks structural integrity to compensate. As a result, the tray 26 bends, or torques, 44 causing the displacement of the contents in the containers 32 and/or dislodging of the containers 32 altogether from the prior art tray 26. With attention to FIGS. 3, 3A and 5, the prior art basins 28 are comprised of prior art walls 25. Unlike the invention 2, the walls 25 of the prior art comprise two distinct planar sections 27 separated at a distinct line 29. Additionally, the through slot 48 in each prior art basin 28 separates the wall 25 of the respective basin 28 from the base 34 of the respective basin 28. Thus, unlike the invention 2, the wall 25 in the prior art does not extend the prior art depth 30 to the base 34 of the respective basin 28.

Figure 6:
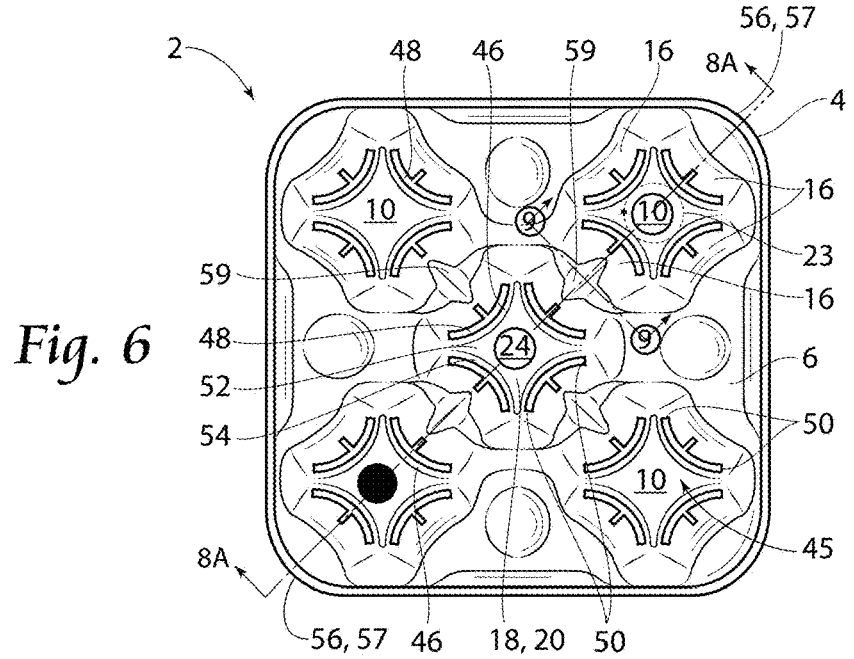
FIG. 6 is a top view of the cup holding tray of the invention.
Figure 7:
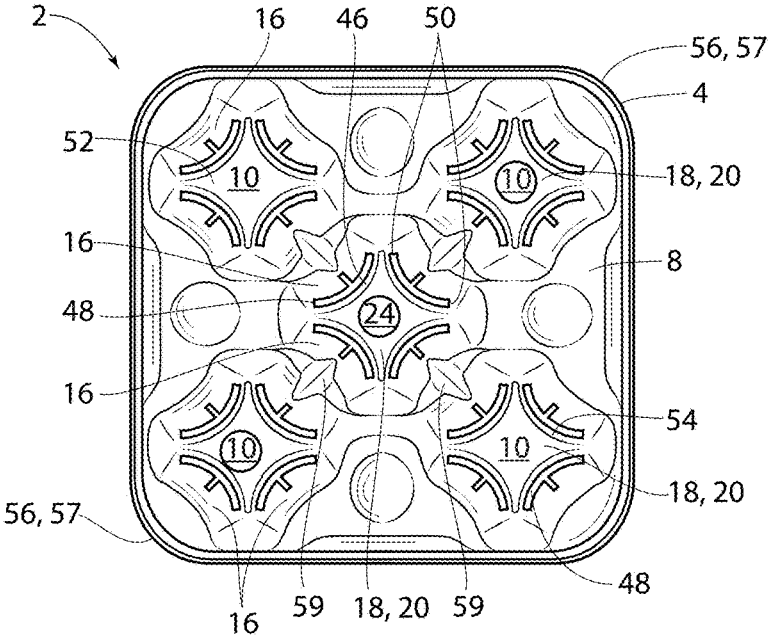
FIG. 7 is a bottom view of the cup holding tray of the invention.

With an understanding of the limitations of the prior art, FIGS. 1, 6 and 7 further illustrate the cup holding tray 2 of the present invention. FIG. 6 is a top view of the cup holding tray 2 and FIG. 7 is a bottom view of the cup holding tray 2. In the preferred embodiment, each cup basin (10, 24) is defined by four support walls 16 in molded communication to define a substantially square basin opening 45 at the plate top surface 6. The walls 16 abut and connect to the base 20. In close proximity to the base 20, each wall 16 provides for a through slot 48. Lateral sides 50 of each wall 16 extend around the slot 48 positioned through the respective wall 16, and extend the wall 16 to the basin base 18. Each wall 16 additionally provides for a lower portion 46, below the respective slot 48. This lower portion 46 is moldably attached to the lateral sides 50 and to the basin base 18. Thus, at least one support wall 16 in each cup basin extends from the plate 4 to the basin base 18.

The basin base 18 of each cup basin (10, 24) in the preferred embodiment has a four-sided shape 52, preferably a four sided star. With each wall 16 contacting a respective side 54 of the of the four side shape of the basin base 18.

With further attention to FIGS. 1, 6 and 7, extending from a first corner 56 of the plate 4 to a second corner 57, opposite the first corner 56, of the plate 4 of the cup holding tray 2, the cup basins (10, 24) are in substantial alignment with one another. Positioned between adjacent cup basins (10, 24), specifically between the center cup basin 24 and each cup basin (10, 24) on the periphery, is a ribbing 59.

Figure 11:
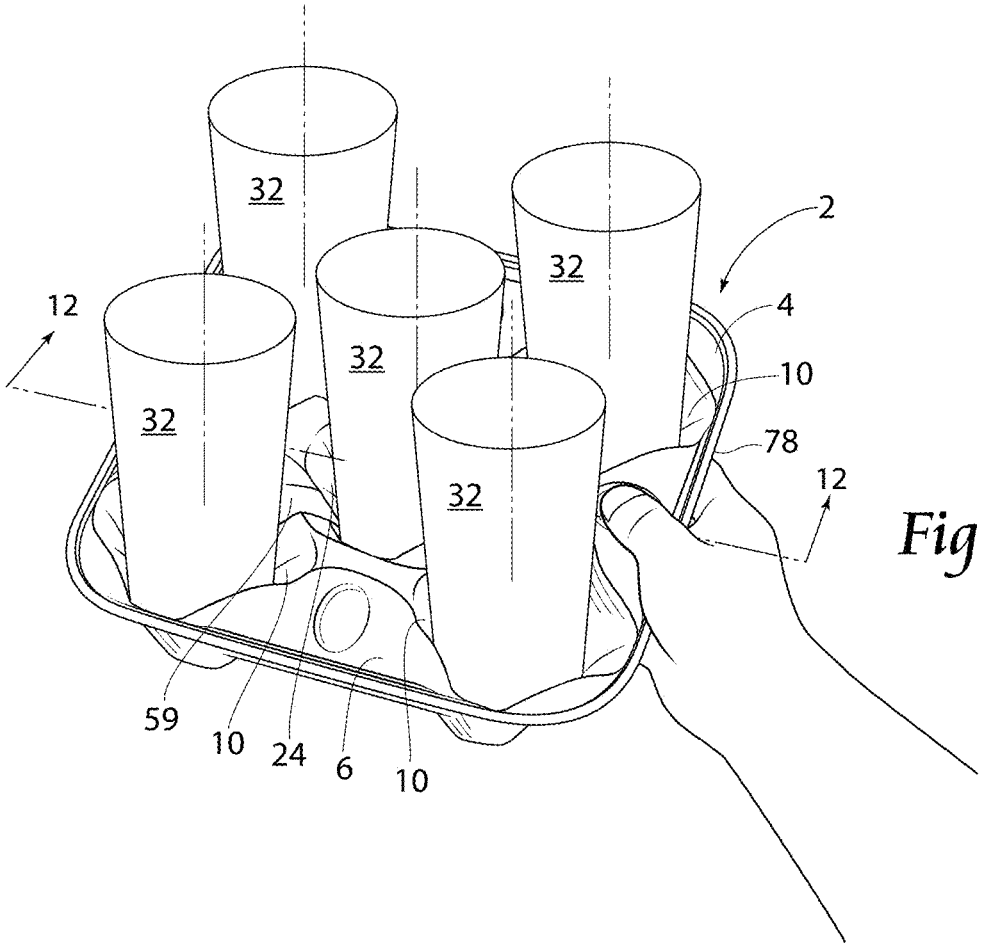
FIG. 11 is a perspective view of the cup holding tray of the invention held by a user on a first side of the cup holding tray.
Figure 12:
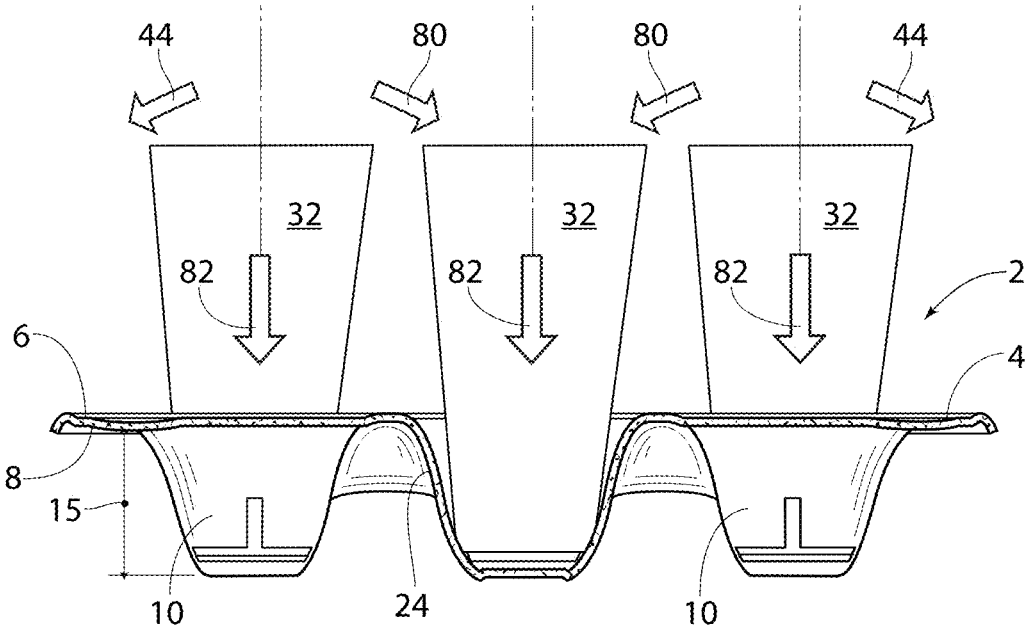
FIG. 12 is a cross-sectional view of the cup holding tray, along line 12 of FIG. 11, illustrating a rigid construction of the cup holding tray of the invention.

As illustrated in FIGS. 11 and 12, a food/beverage container 32 is securely positioned in a cup basin (10, 24) by inserting the container 32 into the respective basin cavity 14. A basin inner diameter 23, illustrated in FIG. 6, of each cup basin (10, 24) is preferably smaller than an outer diameter of the container (not illustrated in the figures). When a container is inserted into the basin 10, the support walls 16, defining the basin diameter 23, contact the container 32. Along with the basin depth 15 providing the cavity 14 to secure the container 32 in a basin (10, 24), the smaller inner diameter 23 of the basin 10, as compared to the diameter of the container 32, frictionally secures the container 32 within the basin (10, 24).

Figure 9:
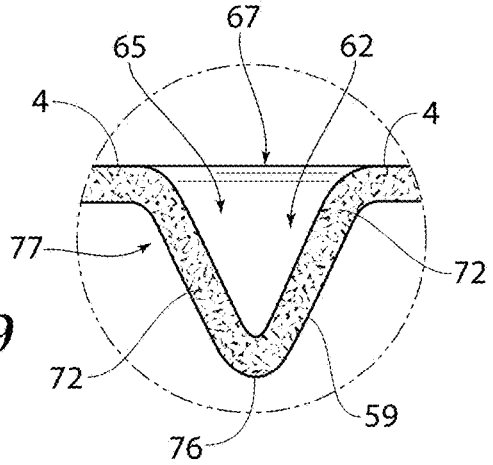
FIG. 9 is a focused cross-sectional view of the cup holding tray, along line 9 of FIG. 6, illustrating a cross-section of the ribbing.

With attention to FIG. 8A, a cross-sectional view of the cup holding tray 2, along line 4A of FIG. 2, illustrates the support walls 16 of cup basins (10, 24). From the first corner 56 to the second corner 57 of the plate 4 of the cup holding tray 2, as previously noted, the cup basins (10, 24) are in substantial alignment with one another. Further the ribbing 59 is positioned between each adjacent cup basin (10, 24). The ribbing 59 is in molded communication with the adjacent support walls 16 of the respective adjacent basins (10, 24). Further, the ribbing is in molded communication with the plate 4. As illustrated in FIGS. 1 and 9, the molded communication between the ribbing 59, the adjacent support walls 16 of the adjacent basins (10, 24) and the plate 4 provides for a ribbing 59 having an elongated V-shaped cross-section 62. The V-shape 62 ribbing 59 extends between the adjacent walls 16 of the adjacent basins (10, 24), with the respective adjacent walls 16 defining the V-shape 62 with a ribbing cavity opening 64 in such a shape 62 within the respective walls which each open into the V-shaped cavity 65 of the ribbing 59. The ribbing 59 provides for a plate opening 67 at the plate 4 to further define the V-shape cavity 65. Thus, the V-shape 62 is defined by the ribbing walls 72 connected at an apex 76, and the plate opening 67. As illustrated in FIG. 9, the cross-section of the ribbing 59, the plate opening 67 and two ribbing sides are positioned to substantially form an equilateral triangle 77. The equilateral triangle 77 construction of the ribbing 59 resists bending and torqueing of the plate 4 and cup holding tray 2, resulting in increased structural rigidity in the plate 4 and cup holding tray 2 as compared to the prior art cup tray 26 lacking ribbing 59.

Figure 8B:
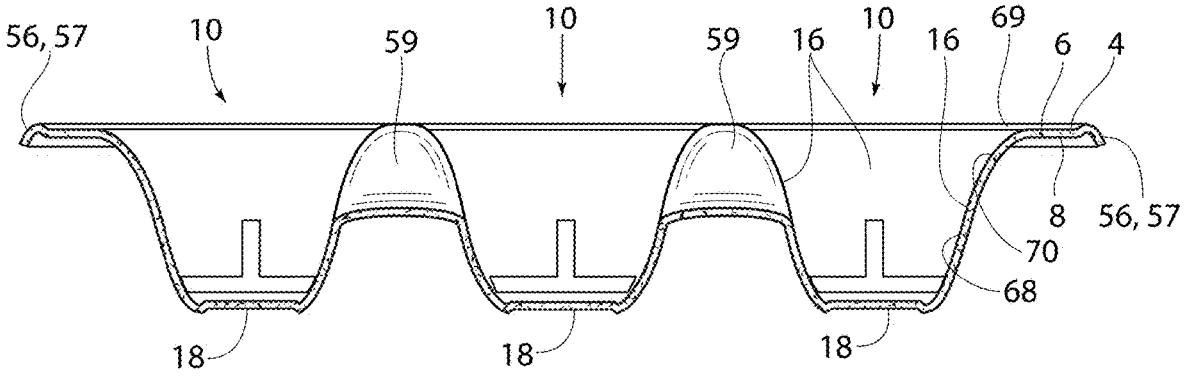
FIG. 8B is a cross-sectional view of the cup holding tray, illustrating an alternative aspect of the support walls of the cup basins.

With continued attention to FIG. 8A, each support wall 16 is preferably a single plane 68 extending from the basin base 18 to the plate 4, where the plane 68 is straight and lacks a line indicative of a sudden change in the angle ($\alpha$) 60 of the plane 68 with respect to the plate 4. Specifically, the connection location between a respective support wall 16 and the plate 4 is at a plate shoulder 69, where the plate shoulder 69 is the transition location between the plate 4 and a respective cup basin (10, 24). As illustrated in FIG. 8B, at least one support wall 16 of a basin 10 may be a single plane 68 where the single plane 68 contains an arch 70 extending less than the distance between the basin base 18 and the plate 4.

Figure 10A:
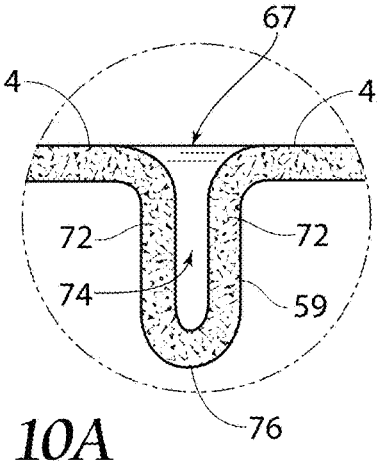
FIG. 10A is a focused cross-sectional view of a first alternative aspect of the ribbing.
Figure 10B:
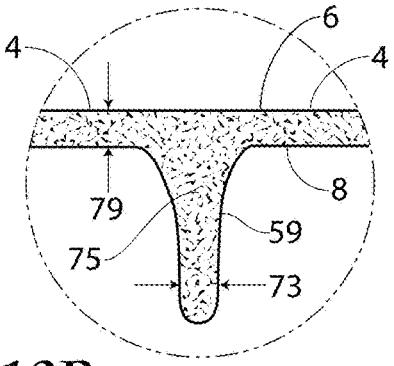
FIG. 10B is a focused cross-sectional view of a second alternative aspect of the ribbing.

With attention to FIGS. 10A and 10B, alternative aspects of the ribbing 59 are depicted. FIG. 10A depicts an alternative aspect of the ribbing 59 which has the same properties as the ribbing 59 previously described with the following exceptions. The ribbing walls 72 are positioned substantially parallel to one another. The close proximity of the ribbing walls 72 provides for a narrow U-shaped ribbing cavity 74. As a result, the plate opening 67 has a distance between the ribbing walls 72. In the case of the alternative aspect in FIG. 10A, the relationship between a length of the ribbing walls 72 and the distance of the opening 67 would potentially have the length of the ribbing walls 72 greater than that of the distance of the opening 67. As illustrated in FIG. 10B, a second alternative aspect of the ribbing 59 consists of an extension 75 of the plate 4 from the plate bottom surface 8 between the respective adjacent basins (10, 24). The extension 75 preferably has an extension thickness 73 similar to that of the plate thickness 79.

With attention to FIGS. 11 and 12, a perspective view of the cup holding tray 2 of the invention held by a user on the first side 78 of the tray 2 is depicted. As illustrated, a container 32 is positioned in each of the four periphery basins 10, and another container 32 is positioned in the center cup basin 24. The positioning of the container 32 securely in the center basin 24 provides for a rigid plate 4 and tray 2. The reason for such benefit is that the location and position of the center basin 24 provides for the center basin to act as a torque and/or bending reducer by countering the mass positioned in the respective periphery basins 10. The bending, or torqueing, 44 of the plate 4 and tray 2, by the containers 32 positioned in the periphery basins 10 is countered by an opposite center focused center of mass 80 of the plate 4 and cup holding tray 2, even more so when a container 32 is securely positioned in the center basin 24. Thus, the center basin 24 provides for a substantially structurally rigid plate 4 and cup holding tray 2.

Further, as illustrated in FIGS. 8A, 8B, 9 and 12, the preferred embodiment of the ribbings 59 are shown. The equilateral triangular construction 77 of the ribbing 59 is substantially maintained during the application of containers 32 to the periphery basins 10. The equilateral triangular construction 77 of the ribbing 59 is further maintained during the application of a container 32 to the center basin 24. Thus, the ribbings 59 provide additional structure for the rigid plate 4 and tray 2. Finally, the combination of the center basin 24 and the ribbings 59 provides for a rigid plate 4 and tray 2. This rigidity results in an at least substantially vertical orientation of forces 82 exerted on the tray 2, and specifically the basin base 18 of each cup basin (10, 24). Thus when in use, contrary to the prior art as illustrated in FIGS. 3 and 5 where the containers 32 rotate away from the center recess 38 of the prior art tray 26 resulting in pouring out of contents in the containers or dislodging of the containers entirely from the tray 26, the containers 32 in the periphery basins 10 of the invention 2 will rest in the respective basins 10 with the contents of the containers 32 remaining in the containers 32 and the containers remaining positioned on the tray 2.

Figure 13A:
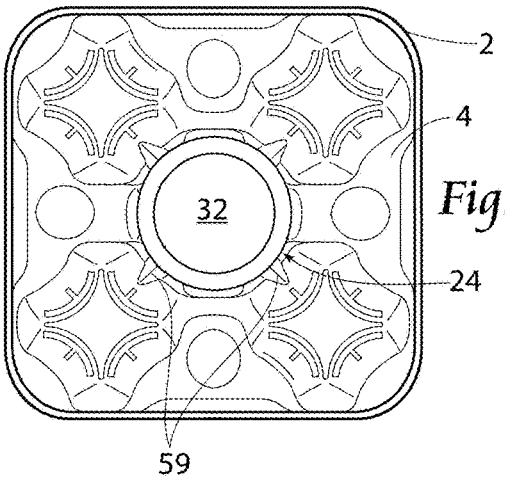
FIG. 13A is a top view of the cup holding tray of the invention, illustrating a first option for a cup placement orientation.
Figure 13B:
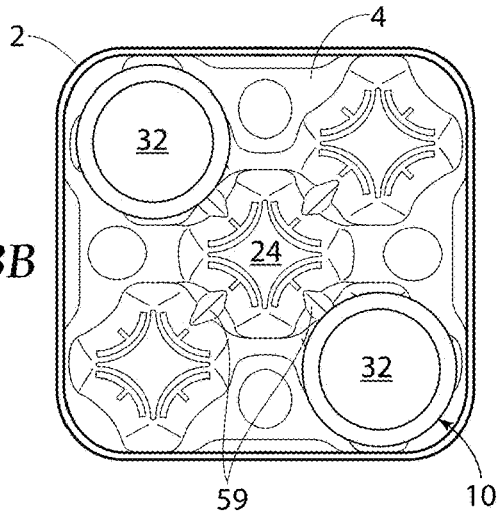
FIG. 13B is a top view of the cup holding tray of the invention, illustrating a second option for a cup placement orientation.
Figure 13C:
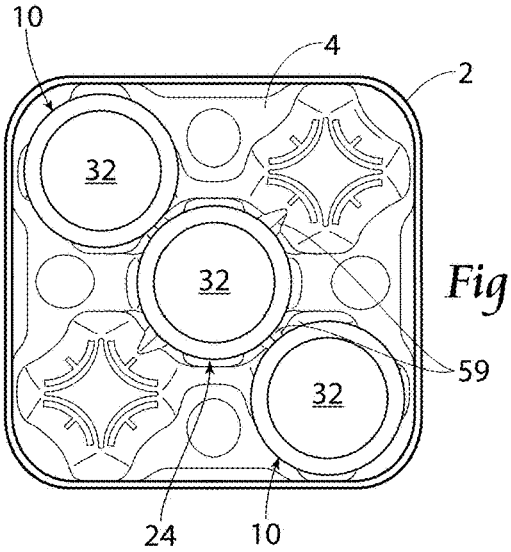
FIG. 13C is a top view of the cup holding tray of the invention, illustrating a third option for a cup placement orientation.
Figure 13D:
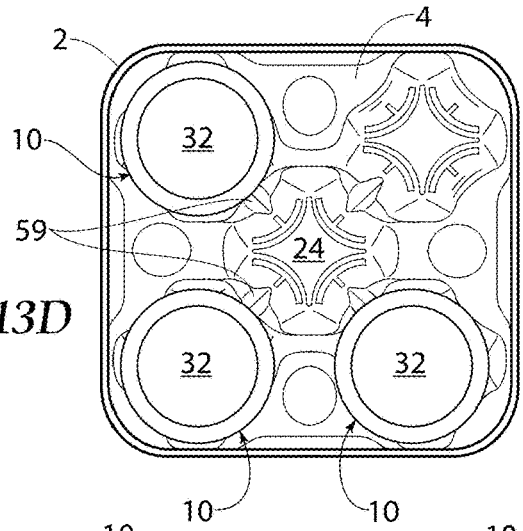
FIG. 13D is a top view of the cup holding tray of the invention, illustrating a fourth option for a cup placement orientation.
Figure 13E:
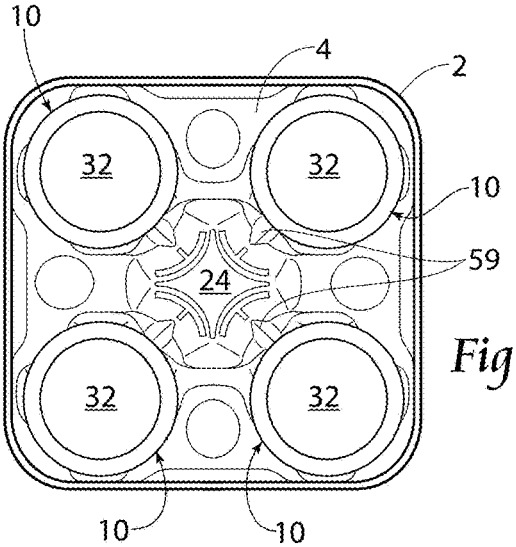
FIG. 13E is a top view of the cup holding tray of the invention, illustrating a fifth option for a cup placement orientation.
Figure 13F:
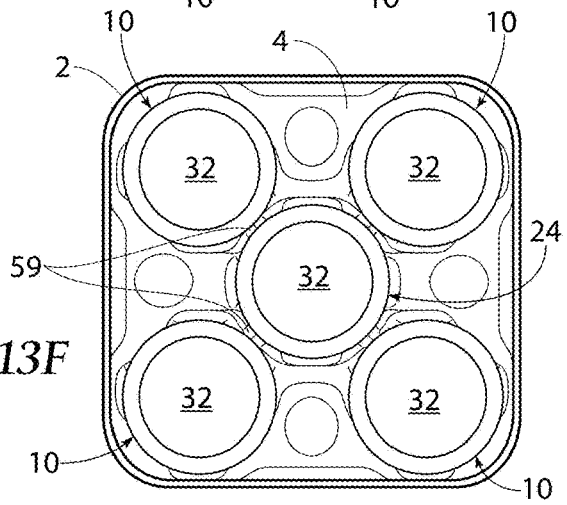
FIG. 13F is a top view of the cup holding tray of the invention, illustrating a sixth option for a cup placement orientation.

With attention to FIGS. 13A to 13F, different container 32 placement orientations in the cup holding tray 2 are depicted. FIG. 13A illustrates a first option for a cup placement orientation, with a single container 32 securely positioned in the center basin 24. FIG. 13B illustrates a second option for a cup placement orientation, with a two containers 32 securely positioned in periphery basins 10, where the periphery basins are opposite one other with the center basin 24 in between as illustrated in FIGS. 8A and 8B. FIG. 13C illustrates a third option for a cup placement orientation, with two containers 32 securely positioned in periphery basins 10 and a third container 32 is securely positioned in the center basin 24, where the periphery basins are opposite one other with the center basin 24 in between as illustrated in FIGS. 8A and 8B. FIG. 13D illustrates a fourth option for a cup placement orientation, with three containers 32 securely positioned each in a respective periphery basin 10 in a triangular pattern. FIG. 13E illustrates a fifth option for a cup placement orientation, with containers 32 securely positioned each in a respective periphery basin 10 about the center basin 24 such that all periphery basins 10 are occupied by containers 32. FIG. 13F illustrates a sixth option for a cup placement orientation, with containers 32 securely positioned in each periphery basin 10 and the center basin 24. In all examples, the rigid construction of the plate 4 and tray 2 is supported by the center cup basin 24 and ribbings 59 as previously described.

Figure 14:
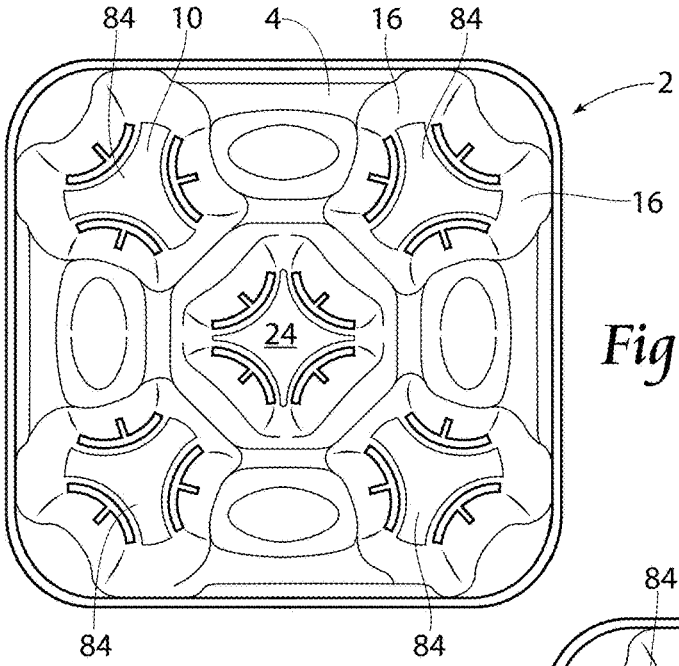
FIG. 14 is a top view of a second aspect of the cup holding tray of the invention.
Figure 15:
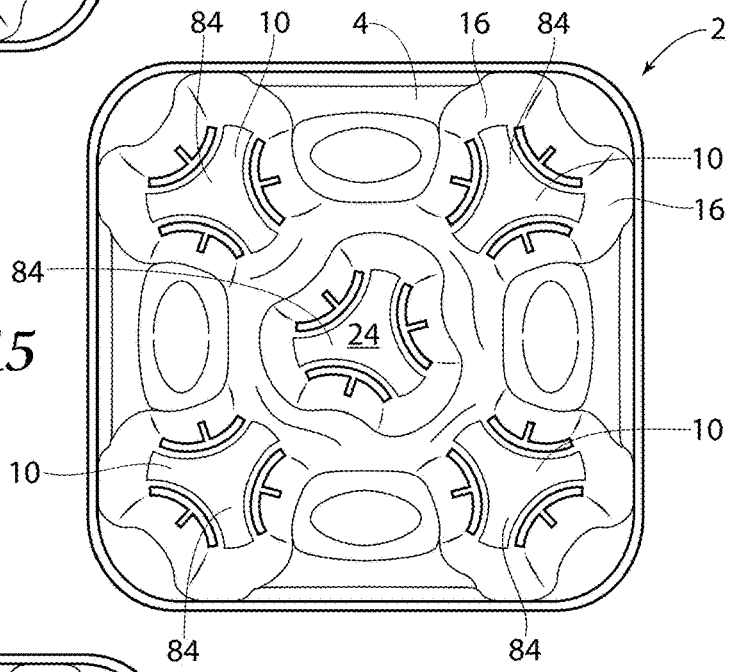
FIG. 15 is a top view of a third aspect of the cup holding tray of the invention.
Figure 16:
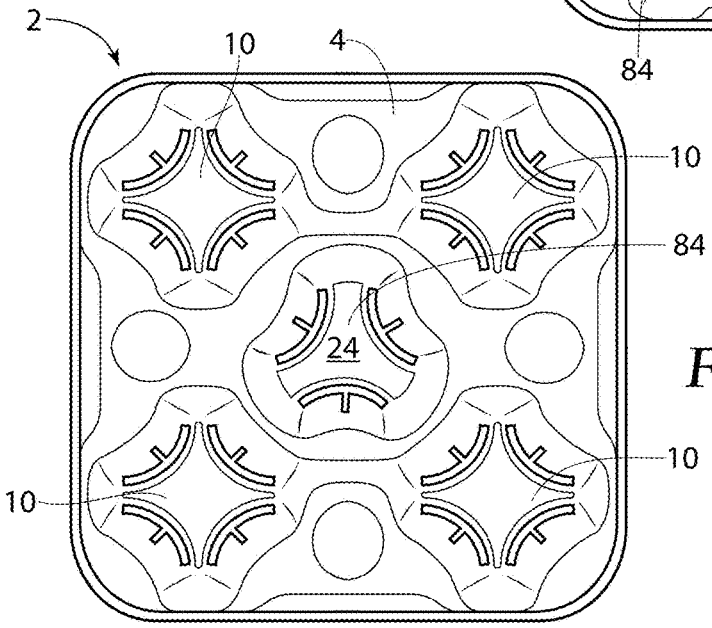
FIG. 16 is a top view of a fourth aspect of the cup holding tray of the invention.

With attention to FIGS. 14 to 16, different aspects of the cup holding tray 2 are illustrated. FIG. 14 illustrates a second aspect of the cup holding tray 2 of the invention. The basin base 18 for each periphery basin 10 is a three-sided shape to provide for an alternative basin 84. Each alternative basin 84 has three support walls 16 which connect with the three-sided basin base 18 as previously described, and interact with the plate 4 as previously described. The alternative basin 84 shares at least one feature with that of the basin (10, 24). The center basin 24 is as previously described. FIG. 15 illustrates a third aspect of the cup holding tray 2 of the invention. In this aspect of the tray 2, the periphery basins 10 and the center basin 24 each are comprised of the three-sided alternative basin 84, as previously described. FIG. 16 illustrates a fourth aspect of the cup holding tray 2 of the invention. The periphery basins 10 each comprise the four sided basin base 18 as previously described. The center basin 24 is comprised of the three-sided alternative basin 84. The different aspects of the cup holding tray 2 continue to comprise the center basin 24 and ribbings 59. Thus, the alternative aspects or variations of the cup holding tray 2 comprise the rigid plate 4, and cup holding tray 2, as previously described.

The invention for the cup holding tray 2 addresses the shortcomings of the prior art. The exemplary prior art tray 26 comprises prior art cup basins 28 about the periphery of the tray 26, and not in the center of the tray 26. This orientation of the basins 28 results in bending and/or torqueing of the tray 26 when containers 32 are inserted in the prior art cup basins 28. The present invention for a holding tray 2 addresses the lack of rigidity prevalent in the prior art trays 26. In doing so, the present invention for the cup holding tray 2 provides for a centrally positioned cup basin 24. The centrally positioned cup basin 24, and use of the basin 24, resists bending and/or torqueing of the tray 2 while in use. Thus, the centrally positioned cup basin 24 increases the rigidity of the tray 2 while in use as compared to the prior art tray 26. Additionally, the cup holding tray 2 of the present invention provides for ribbing 59 between adjacent cup basins (10, 24, 84) further establishing an increased rigidity of the tray 2 of the present invention as compared to the prior art trays 26. Finally, the support walls 16 of the basins (10, 24, 84) comprising a single planar surface or a single curved surface extending from the plate 4 to the basin base 18 in order to facilitate the securing of the containers 32 into the basins (10, 24, 84) and removal of containers 32 from the basins (10, 24, 84).

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described above, the details may be changed without departing from the invention which is defined by the claims.

The invention claimed is:

1. A beverage carrier comprising:
a unitary molded plate;
five basins having identical dimensions and depths inset into the plate;
said five basins comprising four peripheral basins and one center basin; and
four reinforcement ribs, wherein one reinforcement rib is positioned between the center basin and each of the four peripheral basins;
wherein each reinforcement rib comprises a V-shaped depression inset into said plate, each V-shaped depression comprising a substantially 60 degree angle.

2. The beverage carrier of claim 1 further comprising:
the molded plate being rectangular.

3. The beverage carrier of claim 1 further comprising:
the molded plate having four corners.

4. The beverage carrier of claim 1 further comprising:
each said basin being formed from three support walls substantially orthogonal to said molded plate.

5. The beverage carrier of claim 4 further comprising:
a basin base formed in each of said basins at a preselected depth from said molded plate.

6. The beverage carrier of claim 1 further comprising:
each said basin being formed from four support walls substantially orthogonal to said molded plate.

7. The beverage carrier of claim 6 further comprising:
a basin base formed in each of said basins at a preselected depth from said molded plate.

8. The beverage carrier of claim 1 further comprising:
wherein there is an equal distance between each of said peripheral basins and the center basin.

* * * * *